US007940151B2

(12) United States Patent
Parsche et al.

(10) Patent No.: US 7,940,151 B2
(45) Date of Patent: May 10, 2011

(54) INDUCTIVE DEVICE INCLUDING PERMANENT MAGNET AND ASSOCIATED METHODS

(75) Inventors: Francis E. Parsche, Palm Bay, FL (US); John S. Seybold, Malabar, FL (US)

(73) Assignee: Harris Corporation, Melbourne, FL (US)

( * ) Notice: Subject to any disclaimer, the term of this patent is extended or adjusted under 35 U.S.C. 154(b) by 40 days.

(21) Appl. No.: 11/951,673

(22) Filed: Dec. 6, 2007

(65) Prior Publication Data

US 2009/0146772 A1 Jun. 11, 2009

(51) Int. Cl.
*H01F 21/00* (2006.01)

(52) U.S. Cl. ..... 336/110

(58) Field of Classification Search ..... 336/84 R, 336/84 C, 110, 229

See application file for complete search history.

(56) References Cited

U.S. PATENT DOCUMENTS

| | | | | |
|---|---|---|---|---|
| 2,915,637 A | | 12/1959 | McAdam | 250/40 |
| 3,178,946 A | | 4/1965 | Talbot | 73/517 |
| 3,946,340 A | | 3/1976 | Simon | 333/24.1 |
| 4,627,292 A | | 12/1986 | Dekrone | 73/728 |
| 4,723,188 A | | 2/1988 | McMurray | 361/18 |
| 6,114,940 A | * | 9/2000 | Kakinuma et al. | 336/233 |
| 2006/0163971 A1 | | 7/2006 | Gunderson | 310/267 |

FOREIGN PATENT DOCUMENTS

| | | | |
|---|---|---|---|
| JP | 63260114 A | * | 10/1988 |
| JP | 9308150 | | 11/1997 |
| JP | 2005/210783 | | 8/2005 |
| JP | 2007/531818 | | 10/2005 |
| JP | 2005/317623 | | 11/2005 |

* cited by examiner

*Primary Examiner* — Tuyen Nguyen

(74) *Attorney, Agent, or Firm* — Allen, Dyer, Doppelt, Milbrath & Gilchrist, P.A.

(57) ABSTRACT

The radio frequency (RF) inductor includes a core being electrically non-conductive and ferrimagnetic, and having a toroidal shape, and a wire coil thereupon. At least one permanent magnet body is at a fixed position within the interior of the core, and an electrically conductive RF shielding layer is on the at least one permanent magnet body. The core may be ferrite for example. The electrically conductive RF shielding layer may be a conductive plating layer or a metal foil surrounding the permanent magnet body, for example. A magnetic field from the permanent magnet is applied to the inductor core to reduce losses, and the permanent magnet may be enclosed within the conductive shield to keep RF fields out. The inductor may be made small and have increased Q and resulting efficiency. The RF inductor may be applicable to RF communication circuits, for example, as an antenna coupler.

20 Claims, 3 Drawing Sheets

INDUCTIVE DEVICE INCLUDING PERMANENT MAGNET AND ASSOCIATED METHODS

FIELD OF THE INVENTION

The present invention relates to the field of wireless communications, and, more particularly, to inductors and related methods.

BACKGROUND OF THE INVENTION

Inductors are a fundamental electromagnetic component used in to a wide variety of devices, such as actuators, relays, motors, DC-to-DC converters and radio frequency (RF) circuits. Inductors having large inductances typically include wires wrapped around a bulk dielectric or ferrimagnetic core, and are used in power converters and relays. Radio frequency inductors having small inductances typically are helical coils having an air or ferrite core, and are used in RF circuits and communications equipment.

Inductors for the microwave region can become too small to fabricate and suffer low efficiency and Q values. Conventional RF inductor techniques are often abandoned as a result. For instance, the ferrite core, or tunable coil slug, is unusable above VHF due to eddy current losses in the ferrite. Even printed spiral inductors have limited usefulness at microwave frequencies, as magnetic field circulation through silicon substrates results in eddy-current loss, and a higher than normal parasitic capacitance.

Radio frequency (RF) magnetic materials must be nonconductive or nearly so, for the magnetic fields to penetrate. For instance, inductance drops if a solid core of pure iron or steel is placed inside a RF inductor. Yet, if the same material is finely divided into insulated particles then the inductance increases. This is the basis of pentacarbonyl iron or "powdered iron" inductor cores, in which the powder grains may have insulative coatings, and grains size not much larger than the conductor RF skin depth. Nonconductive, highly magnetic atoms are unknown at room temperature and atmospheric pressure.

RF magnetic materials may occur naturally only as lodestone or magnetite. Magnetic permeability is a phenomenon that happens inside atoms, by atomic spin while dielectric permittivity happens between atoms as the dipole moment of polar molecules. With about 100 types of atoms, the options for new magnetic materials are more limited than for dielectrics, as new types of molecules may be created more readily than new types of atoms. Magnetic effects occur inside atoms as spin physics while dielectric effects occur between atoms as dipole moment. Ferrimagnetic materials are ferrites and garnets, materials having high bulk resistivities ($10^7$ Ωm) and are usable at RF and microwave frequencies. Ferromagnetic materials are generally metallic, conductive, and unsuitable for RF applications.

The first synthetic RF ferrites have been attributed to J. L. Snoek of the Phillips Research Laboratories in the Netherlands. Magnetic materials were strategic in World War II, with German developments including isoimpedance magnetodielectrics ($(\mu=\in)>>1$)) ("Schornsteinteger" (*Chimney Sweep*), H. A. Schade, U.S. Naval Technical Mission To Europe, Tech Rep. 90-45 AD-47746, May 1945).

Nickel zinc ferrite cores typically offer high efficiency for a relatively small inductor. However, nickel zinc ferrite is not a perfect insulator. Eddy currents may form due to partial conductivity and resistance losses are exhibited as heat.

U.S. Pat. No. 5,450,052 to Goldberg, et al. is entitled "Magnetically variable inductor for high power audio and radio frequency applications". The patent discloses a magnetically variable inductor for high power, high frequency applications which includes a solenoid with a magnetic core therein, disposed coaxially around a conductor for carrying the high power, high frequency signal, and a variable current source coupled with the solenoid so that a manipulation of the current through the solenoid results in a variable inductance for the conductor.

There exists a need for an inductor with lower losses, higher Q and efficiency. With radio communications moving to higher and higher frequencies, the need is becoming ever more acute. A typical RF communication device, such as a cellular telephone may use more than 20 inductors.

SUMMARY OF THE INVENTION

In view of the foregoing background, it is therefore an object of the present invention to provide an RF inductor with an increased Q and efficiency.

This and other objects, features, and advantages in accordance with the present invention are provided by a radio frequency (RF) inductor including a core being electrically non-conductive and ferrimagnetic, and having a toroidal shape defining an interior, and a wire coil surrounding at least a portion of the core. At least one permanent magnet body is at a fixed position within the interior of the core, and an electrically conductive RF shielding layer is on the at least one permanent magnet body.

The core may be ferrite or nickel zinc ferrite. The electrically conductive RF shielding layer may be an electrically conductive plating layer surrounding the permanent magnet body or a metal foil surrounding the permanent magnet body, for example. The permanent magnet may define a magnetic axis intersecting the core at first and second opposing locations thereof. The permanent magnet may comprise a cylindrical permanent magnet or a plurality of button-style magnets arranged in stacked relation, for example.

A method aspect is directed to making a radio frequency (RF) inductor including providing a core being electrically non-conductive and ferrimagnetic, and having a toroidal shape defining an interior, and positioning a wire coil surrounding at least a portion of the core. The method includes positioning at least one permanent magnet body at a fixed position within the interior of the core, and providing an electrically conductive RF shielding layer on the at least one permanent magnet body.

Thus, a magnetic field from a permanent magnet is applied to the inductor core, e.g. a ferrite core, to reduce losses, and the permanent magnet is enclosed with a conductive shield to keep RF fields out. The relatively small inductor has increased Q and efficiency and may be applicable to RF communication circuits, for example, as an antenna coupler.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
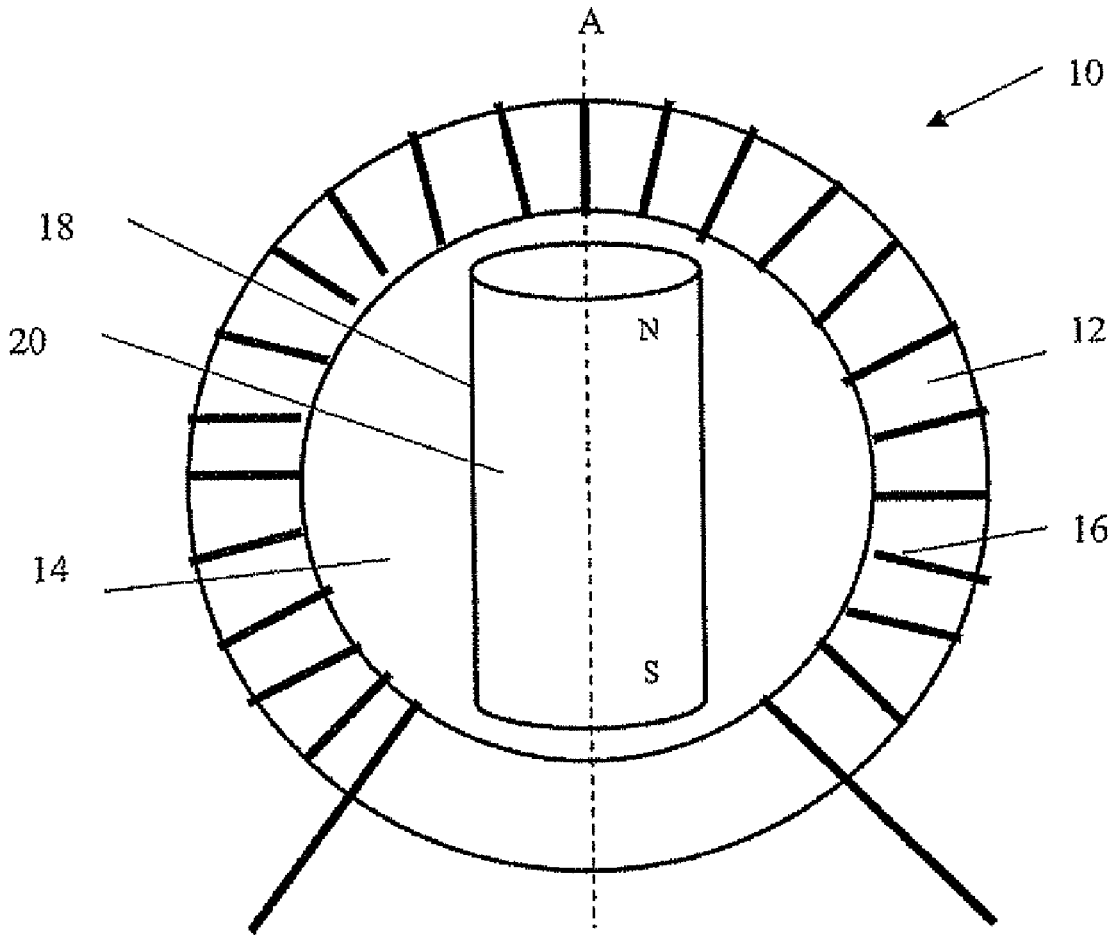
FIG. 1 is a schematic diagram illustrating an RF inductive device including a shielded and fixed permanent magnet in accordance with an embodiment of the present invention.

Referring initially to FIG. 1, an embodiment of a radio frequency (RF) inductor 10 will be described. The RF inductor 10 includes a core 12 being electrically non-conductive and ferrimagnetic, and having a toroidal shape defining an interior 14. The core 12 may be ferrite or nickel zinc ferrite, for example. A wire coil 16 surrounds at least a portion of the core 12. A permanent magnet body 18 is at a fixed position within the interior 14 of the core 12. An electrically conductive RF shielding layer 20 is on the permanent magnet body 18.

Although permanent magnet body 18 may be retained by magnetic attraction to core 12, other ways of fixing the position of the permanent magnet body within the interior core area also contemplated as would be appreciated by this in the art. For instance, the core 12 and the permanent magnet body 18 may be secured to a substrate, such as a printed circuit board (PCB) by adhesives or a plastic clip.

Figure 2:
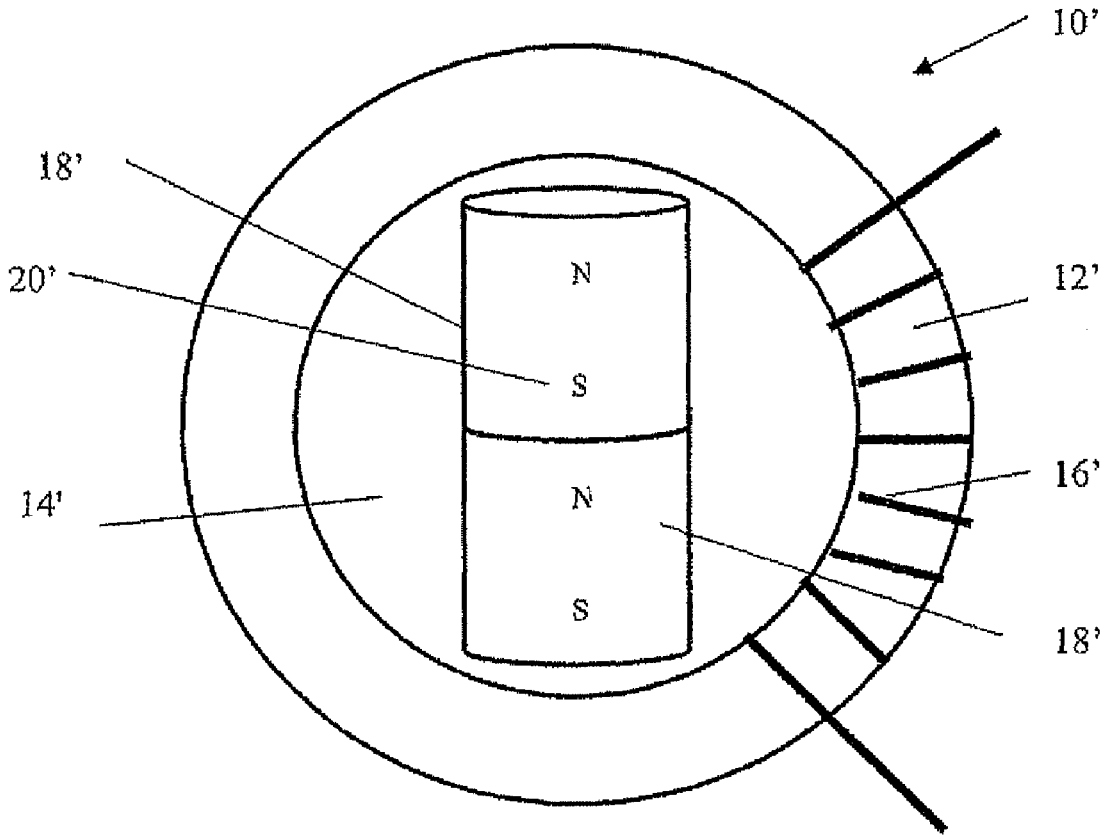
FIG. 2 is a schematic diagram illustrating an RF inductive device including a shielded and fixed permanent magnet in accordance with another embodiment of the present invention.
Figure 3:
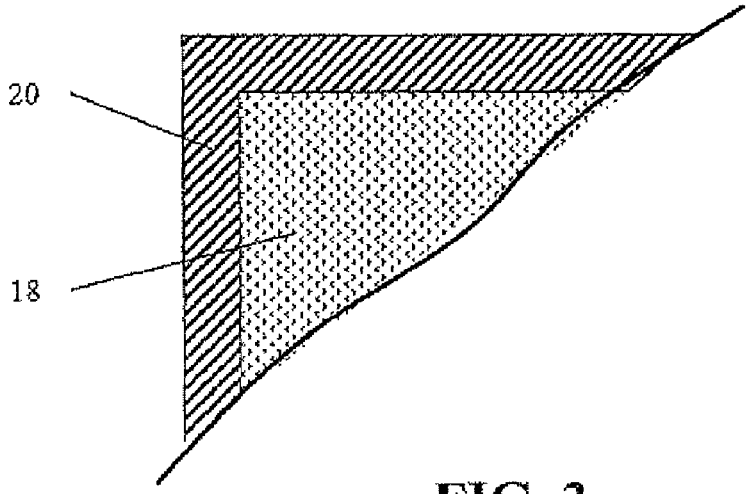
FIG. 3 is a cross-sectional view of a portion of the permanent magnet body and associated RF shielding layer according to an embodiment of the invention.

The electrically conductive RF shielding layer 20, as illustratively shown in cross-section in FIG. 3, may be an electrically conductive plating layer surrounding the permanent magnet body 18 or a metal foil surrounding the permanent magnet body, for example. The permanent magnet body 18 may define a magnetic axis A intersecting the core 12 at first and second opposing locations thereof. The permanent magnet body 18 may comprise a cylindrical permanent magnet, as illustrated in FIG. 1. Alternatively, as illustrated in FIG. 2, the permanent magnet body 18 may comprise a plurality (e.g. two) of button-style magnets 18' arranged in a stacked relation, for example.

Thus the present invention includes separate magnetic circuits or paths for magnetic fields: one for "DC" (steady state) H fields and another for RF H fields. RF skin effect is used to provide a low pass magnetic circuit in the permanent magnet body 18, as RF magnetic fields will not significantly penetrate conductive materials while DC fields will. Thus, permanent magnet 18 does not act as a shunt to the RF magnetic fields present around the toroidal magnetic circuit provided by core 12. Conversely, core 12 readily conveys the steady DC magnetic fields of permanent magnet body 18, and the DC field splits into to separate paths around core 12; one clockwise and the other counterclockwise.

Figure 4:
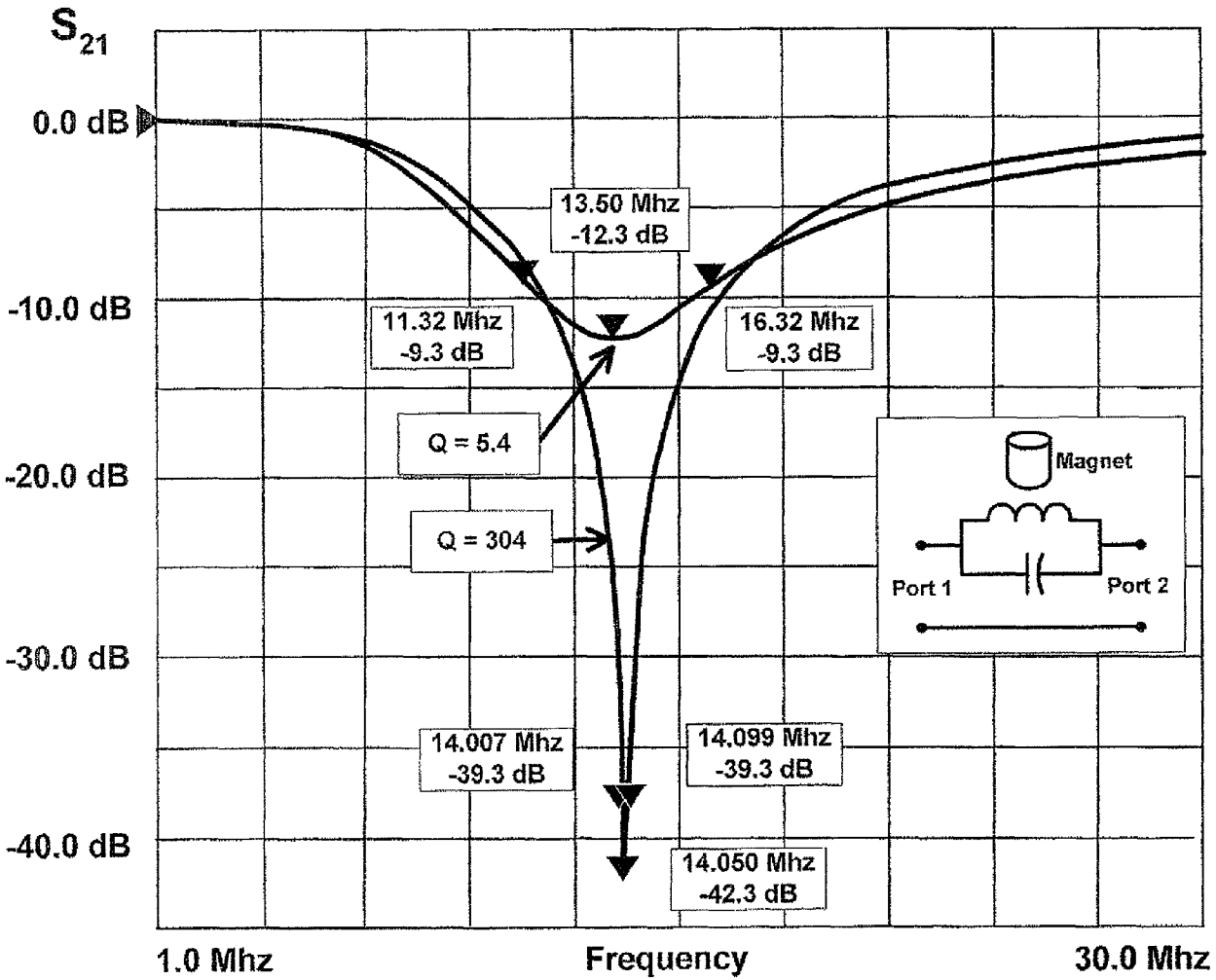
FIG. 4 is a graph illustrating insertion loss ($S_{21}$) of a bandstop filter incorporating the RF inductive device of FIG. 2 compared to same using a conventional toroid inductor, in units of decibels.

FIG. 4 is a graph that illustrates the measured insertion loss ($S_{21}$) of a bandstop filter incorporating an example of the RF inductive device 10' of FIG. 2, compared to the same filter using a conventional toroid inductor. The only difference between the filters was the inclusion of permanent magnet body 18 and in increase in the number of turns in wire coil 16.

Table 1 further details the operating parameters of the conventional device and the present invention:

TABLE 1

Measured Exemplar Filters With And Without The Present Invention

| Parameter | Conventional Inductor | Present Invention Inductor |
|---|---|---|
| Permanent Magnet | No | Yes, Cobalt Samarium Button Type, Nickel Plated |
| Filter Type | Bandstop | Bandetop |
| Core | Amidon - Micrometals FT-50-67 | Amidon - Micrometals FT-50-67 |
| Core Type | Nickel Zinc Ferrite Toroid | Nickel Zinc Ferrite Toroid |
| Inductor Turns N | 2.8 | 16 |
| Toroid Diameter | ½ inch | ½ inch |
| Ferrite Core Magnetic Condition | Unbiased | Near Saturation |
| Realized Permeability of Ferrite Core | 40 | 1.21 (Due To Strong Quiescent H Field) |
| Test Frequency | 14 MHz | 14 MHz |
| Realized Inductance | 1.2 μH | 1.2 μH |
| Inductor Q | ~5.4 | ~304 |
| Filter Center Frequency | 14 MHz | 14 MHz |
| Capacitance Required For Resonance | 110 pf | 110 pf |
| Bandstop Filter Rejection (In 50 ohm system) | −9.4 dB | −42.3 dB |
| Bandstop Filter 3 dB Bandwidth | 36.8% | 0.655% |
| Filter Q | 5.4 | 304 |

The enhancement of performance afforded by the present invention will of course vary depending on the specific ferrimagnetic inductor design to which the permanent magnet body 18 is applied. The exemplar used a relatively large core with a small number of turns prior to the introduction of the magnet, the larger core being preferential for power handling. In both cases the capacitor was of the silvered mica type, with negligible losses, so that the filter Q was approximately that of the inductor Q.

Core permeability μ may be calculated from a common relation between the number of inductor turns N to permeability μ as follows:

$$L=k\mu N^2 \quad [/s1]$$

Where k is an inductance index for a given core, often determined empirically. Such that for constant inductance, $$\mu=kL/N^2$$

A theory of operation for the present invention will now be described. In ferrimagnetic core radio frequency (RF) inductors, total losses are dominated by core losses rather than copper conductor losses in the windings. This is especially the case at higher RF frequencies such as HF and VHF, to which the present invention is most directed Because of this, an improvement in Q and efficiency can be obtained by reducing core permeability and adding additional turns as needed to maintain the specified inductance. In the present invention core permeability is reduced by introducing a quiescent magnetic field from a permanent magnet, which captures and constrains the magnetic spins in the core material. Thus, overall losses are reduced by reducing core permeability and increasing turns which the permanent magnet allows. Inductor core losses are themselves due to eddy currents and hysteresis, which the permanent magnet bias does not increase, as core losses are due to alternating flux density rather than quiescent flux density.

The introduction of strong, permanent magnets into the ferrite toroidal core inductors tested typically reduced the inductors inductance by a factor of about 5 to 10. To compensate and obtain the same inductance with the magnet introduced the numbers of turns N on the inductor core are increased, as will be familiar to those in the art. The resulting permanent magnetic field biased inductors then had the same inductance as the unbiased inductor but lower losses and higher Q value.

Communications channel linearity (freedom from intermodulation products or spurious signals) is a design consideration inherent in circuits using ferrite core inductors. In the present invention, efficiency and linearity may trade in a complex relationship: for small permanent magnetic bias linearity may actually be improved, especially for flux density remote from saturation. Conversely, linearity may be reduced near saturation. As background, linearity relates to magnetic domain grouping or Barkhausen Effect, caused by rapid changes in size of magnetic domains (similarly magnetically oriented atoms in ferrimagnetic materials). In general, the inductor core materials include powdered, pentacarbonyl iron type cores which offer greater linearity but are less DC biasable, and ferrites which may be less linear but more easily DC biased for efficiency enhancement. Powdered iron cores generally saturate less easily then do ferrites.

A method aspect is directed to making a radio frequency (RF) inductor 10, 10' including providing a core 12, 12' being electrically non-conductive and ferrimagnetic, and having a toroidal shape defining an interior 14, 14', and positioning a wire coil 16, 16' surrounding at least a portion of the core. The method includes positioning at least one permanent magnet body 18, 18' at a fixed position within the interior 14, 14' of the core 12, 12', and providing an electrically conductive RF shielding layer 20, 20' on the at least one permanent magnet body.

Accordingly, in the inductive device 10, 10' a quiescent (DC) magnetic field from a permanent magnet 18, 18' is applied to the core, e.g. a ferrite core, to reduce losses, and the permanent magnet is enclosed with a conductive shield 20, 20', e.g. plated or wrapped in metal foil, to keep RF magnetic fields out. The permanent magnet location is inside the ferrite toroid inductor core, e.g. as a Greek $\phi$ configuration. The relatively small inductor 10, 10' has increased Q and efficiency and may be applicable to RF communication circuits, for example, as an antenna coupler. Higher efficiency ferrite or powdered iron core RF inductors may be accomplished at higher frequencies through the present invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) inductor comprising:

an electrically non-conductive, ferrimagnetic core having a toroidal shape defining an interior;

a wire coil surrounding at least a portion of the core;

at least one permanent magnet body at a fixed position within the interior of the core; and an electrically conductive RF shielding layer on the at least one permanent magnet body.

2. The inductor of claim 1, wherein the core comprises ferrite.

3. The inductor of claim 1, wherein the core comprises a nickel zinc ferrite.

4. The inductor of claim 1, wherein the electrically conductive RF shielding layer comprises an electrically conductive plating layer surrounding the at least one permanent magnet body.

5. The inductor of claim 1, wherein the electrically conductive RF shielding layer comprises a metal foil surrounding the at least one permanent magnet body.

6. The inductor of claim 1, wherein the at least one permanent magnet comprises a cylindrical permanent magnet.

7. The inductor of claim 1, wherein the at least one permanent magnet comprises a plurality of button-style magnets arranged in stacked relation.

8. A radio frequency (RF) inductor comprising:

a ferrite core having a toroidal shape defining an interior;

a wire coil surrounding at least a portion of the ferrite core;

at least one permanent magnet body at a fixed position within the interior of the core and defining a magnetic axis intersecting the core at first and second opposing locations thereof; and an electrically conductive RF shielding layer on the at least one permanent magnet body.

9. The inductor of claim 8, wherein the ferrite core comprises a nickel zinc ferrite.

10. The inductor of claim 8, wherein the electrically conductive RF shielding layer comprises an electrically conductive plating layer surrounding the at least one permanent magnet body.

11. The inductor of claim 8, wherein the electrically conductive RF shielding layer comprises a metal foil surrounding the at least one permanent magnet body.

12. The inductor of claim 8, wherein the at least one permanent magnet comprises a cylindrical permanent magnet.

13. The inductor of claim 8, wherein the at least one permanent magnet comprises a plurality of button-style magnets arranged in stacked relation.

14. A method for making a radio frequency (RF) inductor comprising:

providing an electrically non-conductive, ferrimagnetic core having a toroidal shape defining an interior;

positioning a wire coil surrounding at least a portion of the core;

positioning at least one permanent magnet body at a fixed position within the interior of the core; and providing an electrically conductive RF shielding layer on the at least one permanent magnet body.

15. The method of claim 14, wherein providing the core comprises providing a ferrite core.

16. The method of claim 14, wherein providing the core comprises providing a nickel zinc ferrite core.

17. The method of claim 14, wherein providing the electrically conductive RF shielding layer comprises providing an electrically conductive plating layer surrounding the at least one permanent magnet body.

18. The method of claim 14, wherein providing the electrically conductive RF shielding layer comprises providing a metal foil surrounding the at least one permanent magnet body.

19. The method of claim 14, wherein the at least one permanent magnet comprises a cylindrical permanent magnet.

20. The method of claim 14, wherein positioning the at least one permanent magnet comprises positioning a plurality of button-style magnets in a stacked relation.

* * * * *